US008443991B1

(12) United States Patent
Ivey, III

(10) Patent No.: US 8,443,991 B1
(45) Date of Patent: May 21, 2013

(54) RETRACTABLE OVERHEAD, SELF-LEVELING STORAGE ASSEMBLY

(76) Inventor: Ellis Ivey, III, Fountain Inn, SC (US)

( * ) Notice: Subject to any disclaimer, the term of this patent is extended or adjusted under 35 U.S.C. 154(b) by 1226 days.

(21) Appl. No.: 11/751,494

(22) Filed: May 21, 2007

Related U.S. Application Data

(60) Provisional application No. 60/747,813, filed on May 21, 2006.

(51) Int. Cl.
*A47F 5/08* (2006.01)

(52) U.S. Cl.
USPC ..... 211/116; 211/150

(58) Field of Classification Search
USPC ..... 211/116, 85.29, 90.01, 113, 118, 211/149, 150, 168; 108/42, 108
See application file for complete search history.

(56) References Cited

U.S. PATENT DOCUMENTS

| | | | | | |
|---|---|---|---|---|---|
| 181,094 | A * | 8/1876 | Mortimer | 108/99 |
| 462,082 | A * | 10/1891 | High | 211/150 |
| 538,145 | A * | 4/1895 | Allen | 108/1 |
| 638,443 | A * | 12/1899 | Caney | 108/177 |
| 735,915 | A * | 8/1903 | Sherwood | 182/53 |
| 1,582,762 | A * | 4/1926 | Klock | 211/99 |
| 1,896,604 | A * | 2/1933 | Bales | 108/100 |
| 1,937,911 | A * | 12/1933 | Pajeau | 211/116 |
| 2,166,592 | A * | 7/1939 | Illig | 211/116 |
| 2,584,489 | A * | 2/1952 | Morrison | 211/149 |
| 3,827,376 | A * | 8/1974 | Solomon | 108/91 |
| 4,159,831 | A * | 7/1979 | Schorr | 280/79.3 |
| 4,181,234 | A * | 1/1980 | Feighan | 217/122 |
| 4,422,556 | A * | 12/1983 | Moore | 211/119 |
| 4,424,907 | A * | 1/1984 | Robb | 211/70.8 |
| 4,765,495 | A * | 8/1988 | Bisk | 211/113 |
| 4,830,199 | A * | 5/1989 | Wolfe et al. | 211/85.29 |
| 5,072,837 | A * | 12/1991 | Rosch | 211/116 |
| 5,460,280 | A * | 10/1995 | Feddeler | 211/116 |
| 5,593,269 | A * | 1/1997 | Bernard, II | 414/331.04 |
| 5,758,782 | A * | 6/1998 | Rupert | 211/99 |
| RE36,638 | E * | 4/2000 | Herman | 211/149 |
| 6,119,879 | A * | 9/2000 | Acchione | 211/99 |
| 6,571,969 | B2 * | 6/2003 | Larbaletier | 211/150 |
| 6,854,815 | B1 * | 2/2005 | Smith | 312/268 |
| 7,178,769 | B2 * | 2/2007 | Magnusson et al. | 248/201 |
| 2002/0023889 | A1 * | 2/2002 | Larbaletier | 211/150 |
| 2009/0242500 | A1 * | 10/2009 | Li | 211/116 |

* cited by examiner

*Primary Examiner* — Darnell Jayne
*Assistant Examiner* — Stanton L Krycinski
(74) *Attorney, Agent, or Firm* — Herbert J. O'Tode

(57) ABSTRACT

A shelving system attached to an overhead surface that includes a shelving frame pivotally connected to a number of supports that are attached to the overhead surface. A number of hanging shelves are pivotally connected to the shelving frame. One end of the shelving frame can be disconnected from the supports and lowered toward the ground. The other end of the shelving frame rotates with respect to the supports. As the shelving frame is lowered, the hanging shelves rotate with respect to the shelving frame so that the shelves remain horizontal, parallel, and level with the ground. As a result, the storage area provided by the shelves is easily accessible, and the items placed thereon remain on the shelves as the shelving frame is returned to the overhead position.

21 Claims, 6 Drawing Sheets

RETRACTABLE OVERHEAD, SELF-LEVELING STORAGE ASSEMBLY

CLAIM OF PRIORITY

The present application claims the benefit of the United States provisional application filed on May 21, 2006 by Ellis Ivey, III for RETRACTABLE OVERHEAD, SELF LEVELING STORAGE SHELVES (Ser. No. 60/747,813), the entire disclosure of which is hereby incorporated herein by reference.

FIELD OF THE INVENTION

The present invention relates generally to storage shelves. More particularly, the present invention relates to a storage assembly which is a retractable to a raised overhead position but can be lowered into an easily accessible position.

BACKGROUND OF THE INVENTION

Storage solutions for the typical residential home and commercial applications are desirable. Moreover, storage solutions capable of storing items out of the way or in locations not commonly used for other purposes, such as overhead storage shelving systems, are also desirable. Numerous overhead storage systems exist but are typically inconvenient and/or difficult to access. Attempts have also been made to address the convenience and accessibility problems of these overhead systems. For example, accessing existing overhead storage system may require the use of ladders and stepstools. This may exacerbate the danger in lifting large or heavy objects over one's head in order to store the item, which can become unstable and fall potentially causing damage to the item and/or the lifter.

SUMMARY OF THE INVENTION

The present invention recognizes and addresses the foregoing considerations, and others, of prior art construction and methods. In this regard, one aspect of the invention provides a shelving assembly for installation above a ground surface comprising a shelving frame pivotally attached to at least one hanger support and at least one hanging surface pivotally attached to said shelving frame. The hanging surface pivots relative to the shelving frame such that a bottom of the hanging surface stays parallel with the ground surface as the shelving frame pivots relative to the hanger support.

The accompanying drawings, which are incorporated in and constitute a part of this specification, illustrate one or more embodiments of the invention and, together with the description, serve to explain the principles of the invention.

BRIEF DESCRIPTION OF THE DRAWINGS

A full and enabling disclosure of the present invention, including the best mode thereof directed to one of ordinary skill in the art, is set forth in the specification, which makes reference to the appended drawings, in which.

Figure 1:
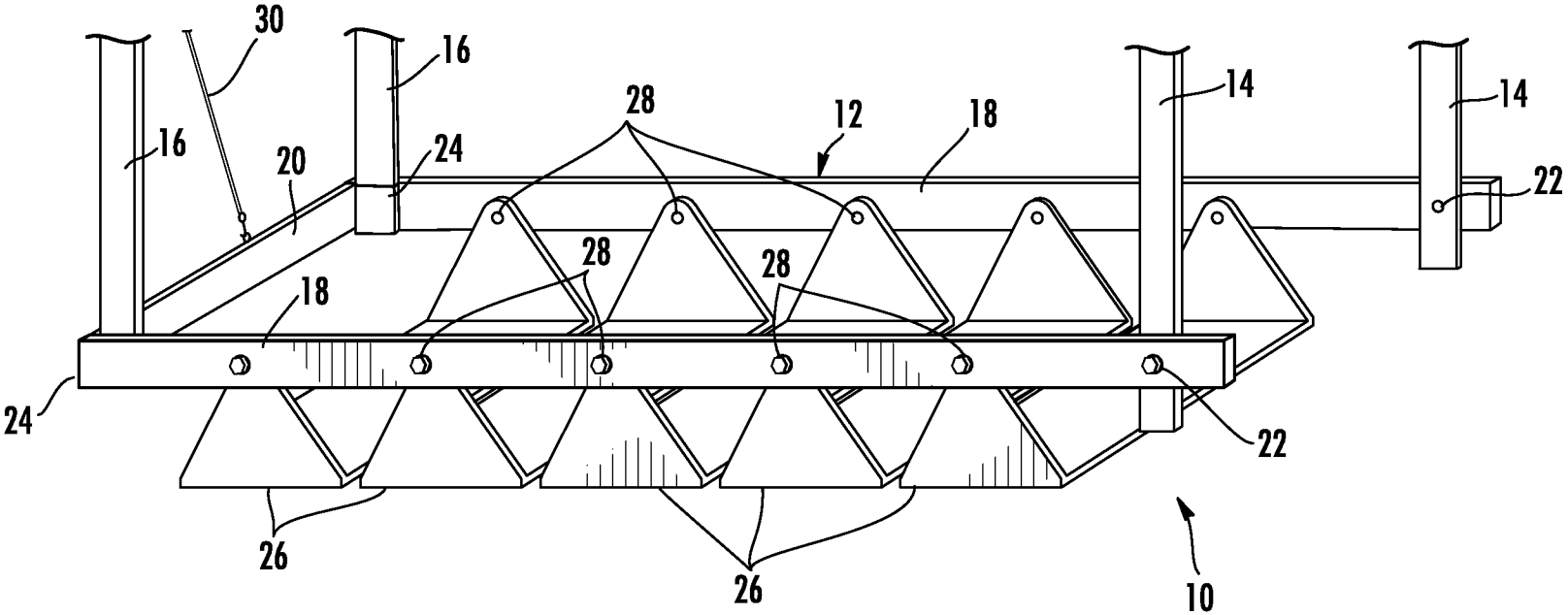
FIG. 1 is a perspective view of an overhead storage shelving assembly with the shelving frame in the raised position in accordance with an embodiment of the present invention.

Repeat use of reference characters in the present specification and drawings is intended to represent same or analogous features or elements of the invention.

DETAILED DESCRIPTION OF PREFERRED EMBODIMENTS

Reference will now be made in detail to presently preferred embodiments of the invention, one or more examples of which are illustrated in the accompanying drawings. Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 illustrates a shelving assembly 10 constructed in accordance with an embodiment of the present invention. Shelving assembly 10 includes a shelf frame 12 attached to main hanger supports 14 and secondary hanger supports 16. Hanger supports 14 and 16 can be attached to almost any overhead structure, including a ceiling, support beams, or joists, or may be formed as part of the weight distribution frame described below. In this embodiment, shelf frame 12 includes two parallel beams 18 connected by a horizontal beam 20 perpendicular to beams 18. Beams 18 are affixed to main hanger supports 14 by hinges 22 (here in the form of a simple pivot) that allow the beams to rotate with respect to the supports. It should be understood by one of ordinary skill in the relevant art that any device capable of rotatably attaching beams 18 to supports 14 may be substituted for hinges 22, such as bolts or bearings. Latches 24 are connected to the distal end of secondary hanger supports 16 and latch to parallel beams 18. Alternatively, latches 24 may latch to horizontal beam 20 or to both horizontal beam 20 and parallel beams 16. It should be apparent that latches 24 may be any attachment devices capable of securing shelving frame 12 to secondary hanger supports 16 while also allowing the shelving frame to be easily detached from the supports and lowered. A number of hanging shelves 26 are affixed to parallel beams 18 by hinges 28. Hinges 28 are similar to hinges 22 so that shelves 26 are able to rotate with respect to parallel beams 18. A retractable support cable 30 is attached to horizontal beam 20 on one end and to the overhead support structure at the other.

Figure 2:
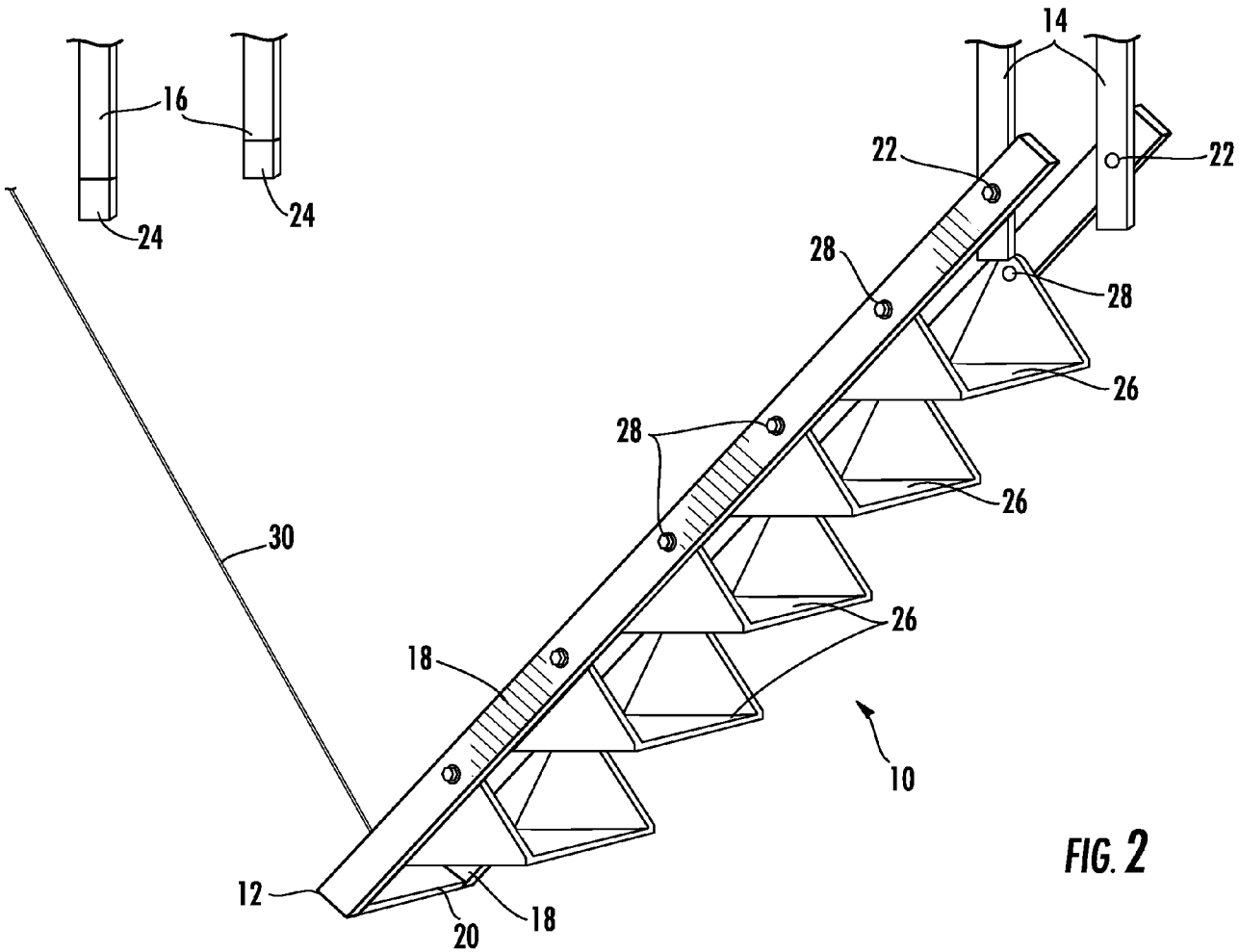
FIG. 2 is a perspective view of the assembly of FIG. 1 as the shelving frame is lowered.
Figure 3:
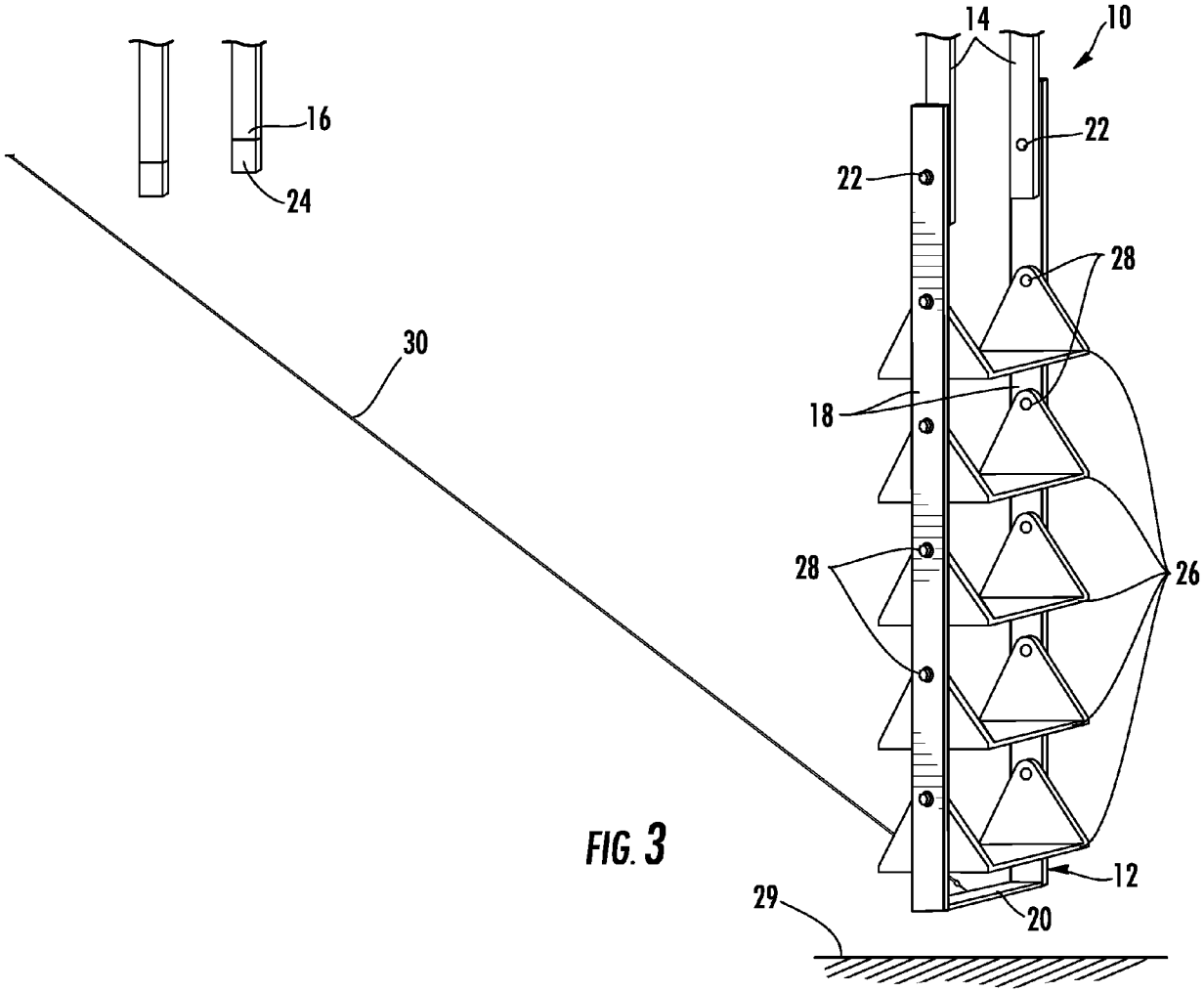
FIG. 3 is a perspective view of the assembly of FIG. 1 with the shelving frame in the lowered position.

FIGS. 2 and 3 illustrate the operation of shelving assembly 10 as shelving frame 12 is lowered away from the overhead support structure and into the lowered position, respectively. Referring to FIGS. 1-3, shelving support frame 12 is secured in the raised position by the connection of parallel beams 18 and/or horizontal beam 20 to secondary hanger supports 16. In this position, hinges 28 allow shelves 26 to hang horizontally, so that the base of the shelves remain parallel to the floor, ground, or other surface 29.

Latches 24 can be unlatched to allow shelving frame 12 to be lowered toward reference surface 29. As shelving frame 12 is lowered, hinges 22 allow parallel beams 18 to pivot about an axis whose center coincides with the hinges. Parallel beams 18 pivot with respect to main hanger supports 14 thereby lowering horizontal beam 20 at the opposite end of shelving frame 12 closer to surface 29. Hinges 28 also allow rotation of hanging shelves 26 in order to permit the shelves to maintain their horizontal position parallel to the floor while shelving frame 12 is lowered. Eventually, as shown in FIG. 3, shelving frame 12 is completely lowered so that horizontal beam 20 is parallel to surface 29 while parallel beams 18 are perpendicular to the surface. Similarly, hanging shelves 26 continue to maintain a horizontal position parallel to surface 29 by rotating on an axis provided by each respective pair of hinges 28.

Tension provided by support cable 30 allows shelving frame 12 to be lowered in a constant, stable manner. It should be understood that other support devices may be used in place of retractable support cable 30 without departing from the scope of the present invention. Cable 30 can be detached from horizontal beam 20 to allow access to hanging shelves 26 from both sides while shelving assembly 10 is in either the raised or lowered position. A mechanism, such as a winch, may be attached to shelving assembly 10, and specifically to cable 30, to assist in lowering and raising shelving frame 12. This mechanism can be manual or automatic device and can be operated controlled by a nearby switch or wireless remote. Such mechanisms, including those employing cables and pulleys, such as garage door openers and actuator devices, should be known to those of ordinary skill in the art. Latches 24 operate such that when shelving frame 12 is returned to its raised position, latches 24 automatically latch to the frame in order to secure it in its raised position.

Throughout the process of lowering shelving frame 12 toward reference surface 29, shelves 26 remain level, horizontal, and parallel to the reference surface (and ceiling). As a result, items placed on hanging shelves 26 stay in their position when shelving frame 12 is raised, lowered, or transitioning between the two. Liquids, paints, and other items that are required to be maintained in an upright position may be stored on shelving assembly 10 and will maintain their upright position while shelving frame 12 is lowered or raised. It should be apparent that other structures on which to store items other than hanging shelves 26 may be desirable, such as baskets, buckets, storage bins, tubs, etc. In fact, any combination of these structures and/or hanging shelves may be used without departing from the scope of the present invention.

Additionally, other devices, such as bungee cords, storage and cargo nets, straps, and other accessories, arranged to help keep items located on hanging shelves 26 in place may be used without departing from the scope of the present invention. Furthermore, it should be realized that, depending on the weight of the items placed on hanging shelves 26 and the support required from hanger supports 14 and 16, hanger supports 14 and hanger supports 16 may be replaced by a single hanger support, respectively.

Figure 4:
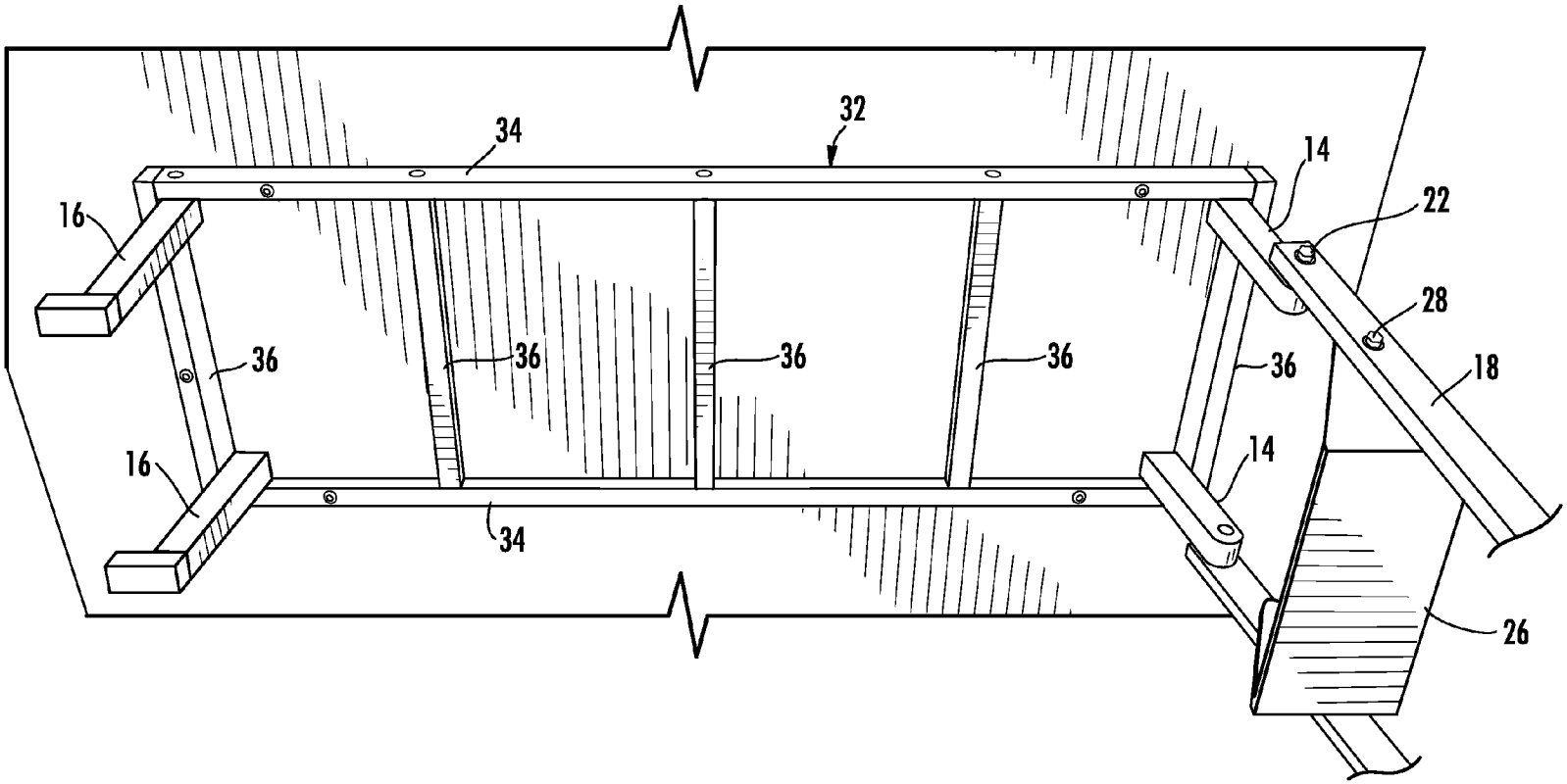
FIG. 4 is a perspective view of a weight distribution frame that may be used with the overhead storage shelving assembly of FIG. 1.

FIG. 4 illustrates an exemplary weight distribution frame 32 that may be used to mount supports 14 and 16 to an overhead structure. In this embodiment, weight distribution frame 32 includes two horizontal side beams 34 parallel to one another and a number of vertical support beams 36 parallel to one another and perpendicular to side beams 34. It should be understood that any number of horizontal and vertical beams may be used depending on the desired size and capacity of each storage system. Weight distribution frame 32 is then mounted to an overhead structure, such as a ceiling, support beams, or joists. Support hangers 14 and 16 are integral parts of weight distribution frame 32. Alternatively, hangers 14 and 16 may be connected to frame 32 by any capable means.

Figure 5:
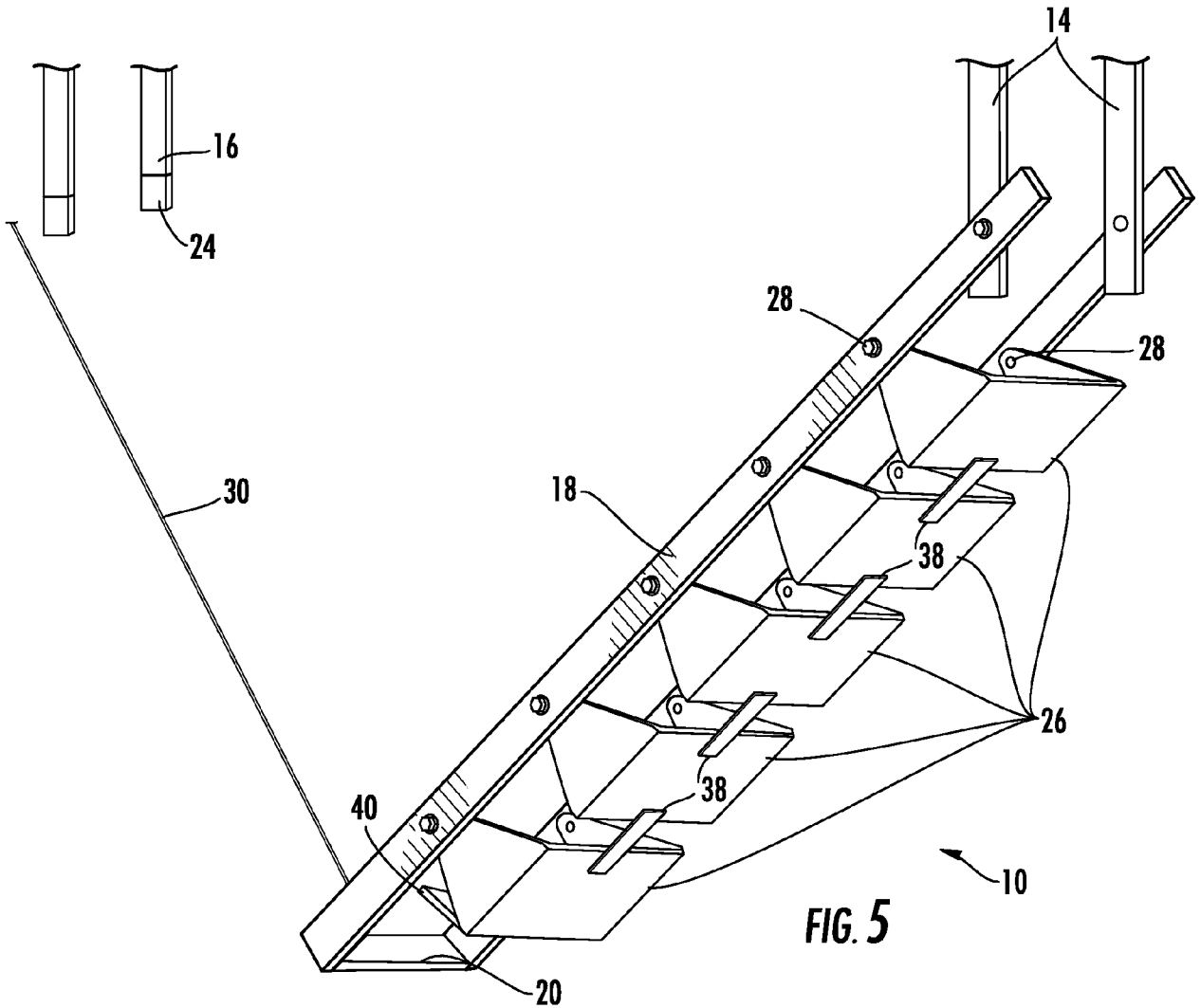
FIG. 5 is a perspective view of an overhead storage shelving assembly including shelf retaining elements in accordance with an embodiment of the present invention.

FIG. 5 illustrates another embodiment of the present invention in which retaining elements (here in the form of clips 38) are affixed to the edges of hanging shelves 26. While any suitable attachment structure may be used to affix clips 38 to the edges of hanging shelves 26, it is preferable to use structures that will allow the clips to be detached and reattached to the shelves as many times as desired, such as snaps or hook-and-loop fasteners. The shelf closest to latches 24 when shelving frame 12 is placed in the raised position may also include an optional footboard 40.

In operation, an item occupying a space too large to allow it to be placed on one hanging shelf may instead be placed across several hanging shelves 26 by connecting the necessary number of shelves together by using clips 38. For example, if a box needs to be stored, the width of which requires that it be placed across two hanging shelves, two shelves may be connected using clips 38 while the remaining shelves are allowed to independently rotate with respect to shelving frame 12 as described above. Similarly, if relatively long pieces of lumber need to be stored, all of hanging shelves 26 may be connected using clips 38 to provide a single, uniform shelf. When shelving frame 12 is in the lowered position in this situation, optional footboard 40 serves as a retainer for longer items that have been placed on the various hanging shelves 26 which have been connected via clips 38 to form a single elongated shelf. Storage accessories, such as bungee cords and cargo nets, may also be used to assist in securing oversized items to hanging shelves 26 in this instance.

Figure 6:
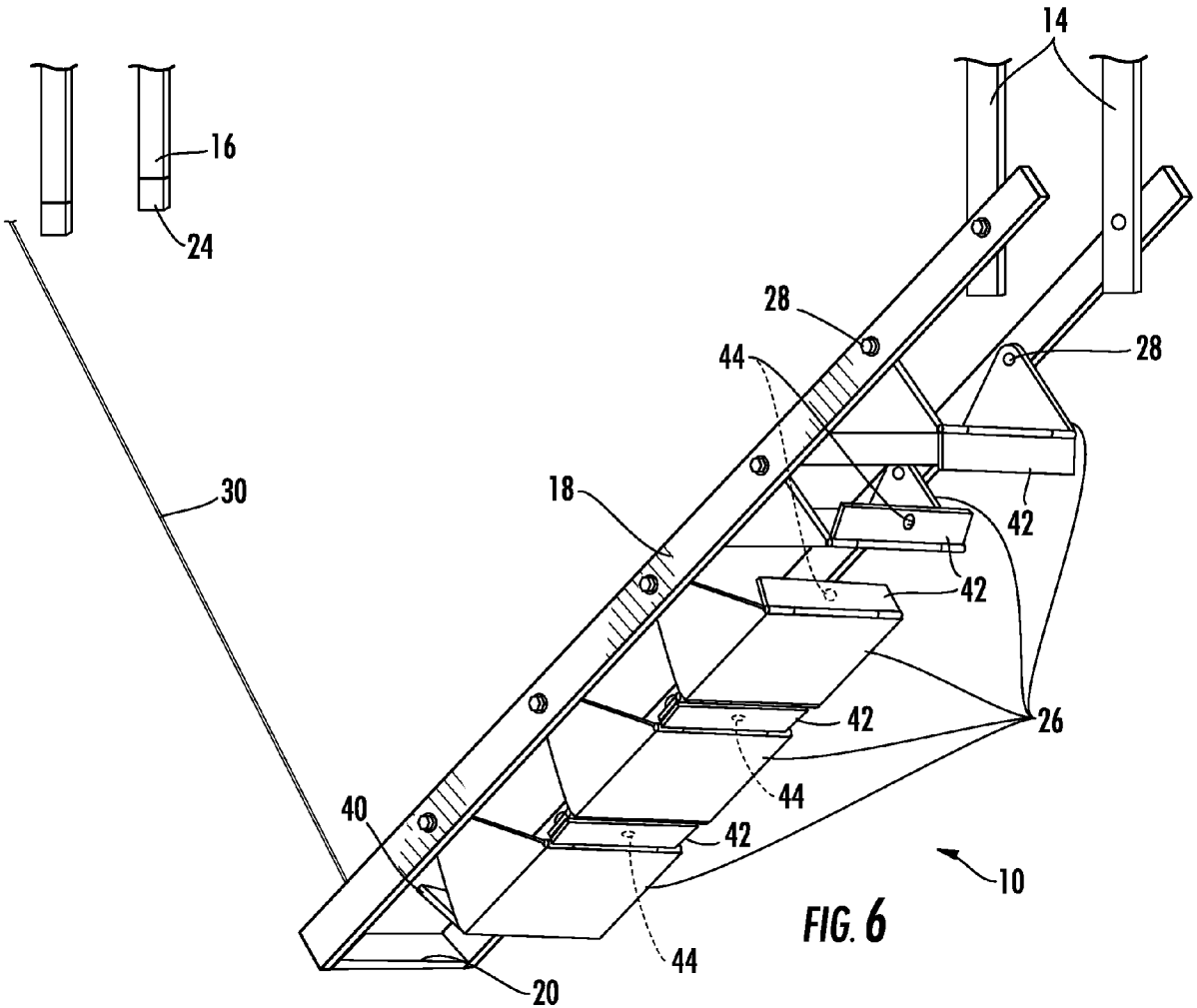
FIG. 6 is a perspective view of an overhead storage shelving assembly in accordance with an embodiment of the present invention.

In another embodiment illustrated in FIG. 6, the retaining element is formed by providing each hanging shelf 26 with a pair of side flaps 42, such that a flap is attached to each side of a shelf. Each side flap 42 includes a suitable fastener such as a snap 44 located on the flap's end farthest from the shelf to which the flap is attached. In operation, a side flap of one shelf may be connected to the side flap of an adjacent shelf using snaps 44. It should be understood by one of ordinary skill in the art that other fastener structures that allow flaps 44 to be disconnected from and reconnected to adjacent flaps, such as fabric hook-and-loop fasteners, may be substituted for snap 46. Connecting hanging shelves 26 using flaps 44 allows two or more shelves to be connected to create a larger hanging shelf to store larger or non-uniformly-shaped items. When not connected to flaps of adjacent shelves, flaps 44 may be positioned as desired. For example, flaps 44 may be placed in the upright position in order to prevent items from rolling off hanging shelves 26. Alternatively, flaps 44 may hang down in order to prevent the flaps from interfering with items that have a base slightly larger than that of the respective shelf.

Although side flaps 44 illustrated in FIG. 6 are rectangular in shape, other shapes and configurations, such as triangular flaps where the base of the triangle is attached to the side of a hanging shelf and the point of the triangle terminates with snap 46, are contemplated. Furthermore, whiles flaps 44 that include snaps 46 are shown, hanging shelves 26 may include fasteners of other configurations or structures in order to interconnect adjacent shelves and to provide ample support for items stored thereon.

In another embodiment, fabric, cloth, or material is attached to shelving frame 12 to enclose hanging shelves 26 and the frame. This allows shelving assembly 10 to exhibit a closed-storage appearance or a more aesthetically-pleasing appearance.

It should be apparent from the description that the storage assembly presented will be familiar and comfortable to people because it resembles a typical freestanding storage shelf unit. The storage assembly presented herein, however, retracts upward, allowing it to be moved out of the way, making use of the storage assembly uncomplicated and efficient. Additionally, the space that would otherwise be occupied by typical shelving systems remains available for other uses. It should also be understood that the present storage assembly provides numerous applications, such as residential garage applications, residential indoor applications, and commercial applications. For example, placement of shelving assembly 10 in a garage over a vehicle parking area would allow for normal operation and use of the garage door and related area when the system is in the raised position. Likewise, shelving assembly 10 may be used indoors in areas with high ceilings, such as basements or attics, allowing users to move about under the shelving system when in the raised position.

Shelving assembly 10 may be composed of various materials depending on the application. For example, garage applications may required heavy-duty supports, shelves, and frames in order to provide support for storage of automotive, gardening, and home repair items. Similarly, shelving assembly 10 may be composed of a plastic or rubber-coated wire frame, in combination with similarly-constructed baskets, ideal for storing clothing and other household items when used for indoor residential applications. Increasing the overall scale of shelving assembly 10 and its components generally would allow the system to be used for commercial applications.

It should be apparent that the length of hanging supports 14 and 16 may be altered depending on the height of the overhead support structure, the desired length of shelving frame 12, and the depth of hanging shelves 26 in order to provide accessibility to the system from floor level.

While one or more preferred embodiments of the invention have been described above, it should be understood that any and all equivalent realizations of the present invention are included within the scope and spirit thereof. The embodiments depicted are presented by way of example only and are not intended as limitations upon the present invention. Thus, it should be understood by those of ordinary skill in this art that the present invention is not limited to these embodiments since modifications can be made. Therefore, it is contemplated that any and all such embodiments are included in the present invention as may fall within the scope and spirit thereof.

I claim the following:

1. A retractable, overhead, self-leveling storage assembly (10) for storing items over a substantially horizontal surface comprising:

(a) at least two main hanger supports (14) secured to an overhead structure;

(b) a shelf frame (12) comprising two parallel frame beams (18) and at least one beam (20) connecting said parallel frame beams (18);

(c) means for connecting said parallel frame beams (18) to said main hanger supports (14);

(d) a plurality of hanging shelves (26) pivotally attached to said parallel frame beams (18);

whereby said shelves pivot to remain substantially level with the horizontal as the storage assembly is moved from the vertical to the horizontal position.

2. The shelving assembly of claim 1 wherein said hanging shelves have a substantially flat surface.

3. The shelving assembly of claim 1 wherein said hanging shelves are baskets.

4. The shelving assembly of claim 1 further comprising:

(a.) at least one secondary hanger support (16) connectible to said shelf frame at the end of said shelf frame away from said main hanger support.

5. The shelving assembly of claim 4 further comprising:

(a.) at least latch (24) connected to a distal end of said secondary hanger support, wherein said latch is configured to connect said shelf frame to said secondary hanger support.

6. The shelving assembly of claim 4 wherein: said main hanger supports and said secondary hanger support are integrated within a weight distribution frame.

7. A retractable overhead, self-leveling storage assembly (10) according to claim 1 further comprising:

(e) a support cable (30) attached to said shelf frame (12) distal from said main hanger supports (14), said cable providing tensional force while raising and lowering of said shelf frame.

8. The shelving assembly of claim 7 wherein:

(a.) at least one of said hanging shelves has a substantially flat surface.

9. The shelving assembly of claim 7 wherein:

(a.) said support cable is detachable from said shelf frame.

10. The shelving assembly of claim 7 further comprising:

(a.) a mechanism attached to said support cable wherein said mechanism is configured to retract and extend said support cable to assist in movement of said shelf frame.

11. The shelving assembly of claim 10 wherein:

(a.) said mechanism is a winch.

12. The shelving assembly of claim 10, wherein:

(a.) operation of said mechanism is externally controlled.

13. The shelving assembly of claim 12 further comprising:

(a.) a switch operatively connected to said mechanism, wherein said switch controls the operation of said mechanism.

14. The shelving assembly of claim 12 further comprising:

(a.) a wireless remote operatively connected to said mechanism, wherein said wireless remote controls the operation of said mechanism.

15. The shelving assembly of claim 13 wherein:

(a.) said switch is situated at a location remote from said mechanism.

16. A retractable, overhead, self-leveling storage assembly according to claim 1, further comprising at least one retaining element (38) attached to at least one of said plurality of hanging shelves.

17. A shelving assembly according to claim 16 wherein said retaining element attaches to two bottoms of two adjacent hanging shelves.

18. A shelving assembly according to claim 17, wherein:

a first retaining element is comprised of a first flap, wherein said first flap includes a first fastener and is attached to a first edge of said first hanging shelf; a second retaining element is composed of a second flap, wherein said second flap includes a second fastener and is attached to a second edge of a second hanging shelf wherein said second edge is adjacent to said first edge and said fastener is configured to fasten to said first fastener in order to connect said first hanging shelf to said second hanging shelf.

19. A shelving assembly according to claim 18 wherein said first retaining element is integral to said hanging shelf.

20. A shelving assembly according to claim 19 wherein said first retaining element is a footboard.

21. A shelving assembly according to claim 1 further comprising a detachable support cable attached to said shelf frame and under tension during movement of said shelf frame.

* * * * *